United States Patent [19]

Miller et al.

[11] 4,098,194

[45] Jul. 4, 1978

[54] HYPERVELOCITY PROJECTILE WITH ALUMINUM COMPONENTS OF HIGH RESISTANCE TO THERMODYNAMIC ABLATION

[75] Inventors: Gary M. Miller; Curtis J. Koch, both of Waterloo, Iowa

[73] Assignee: The United States of America as represented by the Secretary of the Army, Washington, D.C.

[21] Appl. No.: 802,412

[22] Filed: Jun. 1, 1977

[51] Int. Cl.[2] ..... F42B 11/00; C25D 11/08

[52] U.S. Cl. ..... 102/105; 204/58; 427/344

[58] Field of Search ..... 102/105, 92.1; 204/58, 204/56 R, 35 R, 35 N; 427/135, 344, 419 A, 419 B, 419 C

[56] References Cited

U.S. PATENT DOCUMENTS

| | | | |
|---|---|---|---|
| 1,946,153 | 2/1934 | Edwards | 204/58 |
| 2,076,898 | 4/1937 | Labus | 427/419 B |
| 2,151,048 | 3/1939 | Rowe | 204/58 |
| 2,692,851 | 10/1954 | Burrows | 204/58 |
| 3,376,205 | 4/1968 | Cohn | 204/58 |
| 3,812,023 | 5/1974 | Schardein | 204/58 |
| 3,830,666 | 8/1974 | Schneider | 102/105 |
| 3,846,182 | 11/1974 | Huff | 427/419 A |
| 3,956,080 | 5/1976 | Hradcovsky | 427/344 |

*Primary Examiner*—Verlin R. Pendegrass
*Assistant Examiner*—Donald P. Walsh
*Attorney, Agent, or Firm*—Nathan Edelberg; Harold H. Card, Jr.; A. Victor Erkkila

[57] ABSTRACT

A hypervelocity projectile is provided with aluminum components, such as fins and windshields, which possess a coating having high resistance to thermodynamic ablation on the aluminum components. The coating is formed by first producing a "hard" anodic coating on the aluminum component by anodic oxidation of the aluminum in an acid electrolyte maintained below 10° C, and sealing the hard coating with a hot aqueous solution of an alkali metal silicate of the formula $Me_2O{:}x.SiO_2$, wherein Me is an alkali metal and $x$ is at least about 2.0, e.g., a 5 - 10% aqueous solution of $Na_2O{:}x.SiO_2$, wherein $x$ is about 3.25.

4 Claims, 1 Drawing Figure

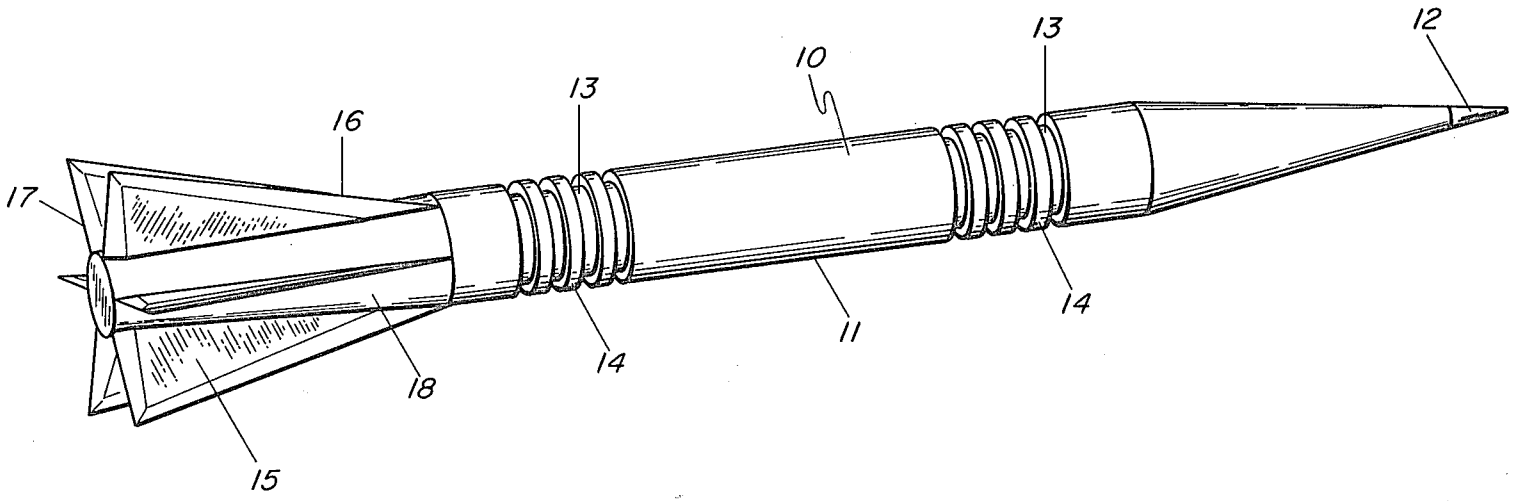
12
13
14
10
11
13
14
16
18
15
17

HYPERVELOCITY PROJECTILE WITH ALUMINUM COMPONENTS OF HIGH RESISTANCE TO THERMODYNAMIC ABLATION

GOVERNMENTAL INTEREST

The invention described herein was made in the course of a contract with the Government and may be manufactured, used and licensed by or for the Government for governmental purposes without the payment to us of any royalty thereon.

BACKGROUND OF THE INVENTION

The present invention relates to the production of coatings of improved thermal resistance on articles of aluminum or aluminum alloys. It is particularly directed to the provision of coatings of high resistance to thermodynamic ablation on aluminum components, e.g., fins and windshields, of projectiles, especially hypervelocity kinetic energy projectiles. Military projectiles of this type, such as the 105mm XM735 and XM774 projectiles, have been recently developed to provide a particularly effective type of anti-tank weapon. Such projectiles normally travel at considerably higher than supersonic speeds.

Various methods have been employed to prevent aerodynamic thermal ablation on aluminum components, notably fins, of such hypervelocity projectiles. Prior to the present invention the most effective method to this end involved coating the aluminum fins with a thick, dense, hard anodic finish, commonly known as a "hard coating", which possesses excellent hardness and resistance to heat and abrasion and is obtained essentially by the anodic oxidation of aluminum using a refrigerated, acid electrolyte maintained below 10° C. However, the hard coatings thus obtained showed evidence of breakdown when such projectiles were fired at extended ranges. When such a hard coating is broken down, the base aluminum erodes very rapidly from the combined heat and friction with the airstream. Once ignited, the aluminum burns synergistically, thereby destroying the basic aerodynamic shape of the component. Asymmetric drag is induced on badly ablated aluminum parts, which causes the projectile to become unstable and thus adversely affect accuracy.

SUMMARY OF THE INVENTION

In accordance with this invention, aluminum components of projectiles, e.g., fins and windshields, are provided with a hard anodic coating of increased resistance to aerodynamic thermal ablation on the aluminum component in known manner by anodic exidation of the aluminum in a refrigerated acid electrolyte maintained essentially below 10° C, and then sealing the hard anodic coating thus obtained by contact with a hot aqueous solution of an alkali metal silicate of the formula $Me_2O{:}x.SiO_2$, wherein Me is an alkali metal, such as sodium and potassium, and $x$ is at least about 2.0. The coating obtained according to the present invention provides a superior thermal barrier between the airstream and the base aluminum to prevent heat and friction from softening and ablating the aluminum.

It was previously known to improve the corrosion resistance of anodic coatings on aluminum by sealing with a soluble silicate, such a sodium silicate. However, prior to applicants' discovery, it was not known that the termal resistance of hard coatings on aluminum and aluminum alloys, particularly the resistance to aerodynamic thermal ablation of such hard coatings on aluminum fins of hypervelocity projectiles due to friction with the atmosphere, could be greatly increased by sealing with an aqueous solution of a soluble silicate of of the aforesaid type. Applicants' discovery was also not obvious in view of the fact that usually, hard anodic coatings are not sealed because of a resultant reduction in resistance to abrasion by as much as 20%, although in certain instances, hard anodic coatings are sealed to provide maximum resistance to corrosion.

The mechanism of sealing of the hard anodic coating with alkali metal silicate is not clearly understood. It is probable that the alkali silicate reacts with the sulfuric acid or other acid trapped or present in the minute pores of the hard anodic coating to precipitate water-insoluble silicon dioxide (silicic acid) in the tiny pores of the hard coating.

BRIEF DESCRIPTION OF THE DRAWING

The drawing illustrates a hypervelocity projectile fitted with aluminum fins containing the thermally resistant coating of the present invention.

DETAILED DESCRIPTION OF THE INVENTION

In accordance with the present invention, the coatings on the aluminum fins, which possess the high resistance to aerodynamic thermal ablation at hypervelocities, are produced by sealing a hard anodic oxide coating with an aqueous alkali metal silicate solution defined above. Such hard anodic oxide coatings, commonly known as "hard coatings", provide extra hard, wear-resistant surfaces, which are distinguished from the conventional anodic finishes employed for decorative or protective purposes. Conventional anodic finishes or coatings do not provide the resistance to abrasion and wear which are obtainable with the "hard" type of surface coating. As is well known in the art, the hard coatings are obtained by anodic oxidation of aluminum or aluminum alloys essentially employing a refrigerated acidic electrolyte maintained at a temperature below 10° C. (See "The Technology of Anodizing Aluminum," by A. W. Brace (1968), pages 127 et seq.; U.S. Patents 2,692,851-2).

The sealing with the alkali metal silicate solution can be carried out by contacting the hard coating after removal of the aluminum component from the anodizing bath and preferably after rinsing with water to remove a substantial part but not all of the acid adhering thereto, with the aqueous silicate at an elevated temperature, preferably at least about 65° C. If desired, after the silicate sealing step the aluminum component can be returned to the refrigerated acid anodizing bath and subjected to hard coat anodizing conditions and then treated with the aqueous silicate sealing solution in the aforesaid manner to seal the coating. This procedure can be repeated to build up the thickness of the silicate sealed hard coating on the aluminum component and thus increase the resistance thereof to thermal ablation.

Aqueous sodium silicates wherein the ratio of $SiO_2$ to $Na_2O$ ranges about from 3:1 to 4:1, are the preferred sealing agents in view of their effectiveness, availability and low cost. The aqueous sodium silicate sealing solutions are preferably neutral or only slightly alkaline, i.e., not above about pH 12, and advantageously contain about 5 to 10% by weight of the sodium silicate, although other concentrations can be employed. Similar results can be obtained by carrying out the sealing procedure in analogous manner with other alkali metal silicates, such as potassium silicate and lithium silicate, wherein the ratio of silicon dioxide to alkali metal oxide is at least about 2.0.

The term aluminum, as used in the specification and claims, is understood to include pure or substantially pure aluminum as well as alloys of aluminum containing in general at least about 85% by weight of aluminum on which hard anodic coatings can be produced, as is known in the prior art, for example U.S. Pat. No. 2,692,851, which is incorporated herein by reference.

The following example illustrates a specific embodiment of the invention.

PART A. PREPARATION OF THE HARD ANODIC COATING

The fin blades were of the type utilized in XM735 and XM774 hypervelocity projectiles and were made of extruded or forged 2014 aluminum alloy. As shown in the drawing, the fins had the shape of a right angled triangle having the following dimensions: height 1.5 in., base 4.1 in., thickness 0.1 in. with the leading and rear edges bevelled to a thickness at the edge of 0.04 in. The fin blades were thoroughly cleaned free of grease and other foreign matter and given an anodic oxide coating of 2 to 3 mils thickness according to the method described in U.S. Pat. No. 2,692,851, as follows: The fin blades were made the anode in an electrolytic cell having an electrolyte consisting of 250 grams/liter of $H_2SO_4$. During the coating operation of about 90 minutes duration, the electrolyte was vigorously agitated and maintained at a temperature of 5° C while employing a direct current at a current density of about 25 amperes per sq. ft. with a voltage of about 20 volts at the start of the coating operation and increasing thereafter to maintain the desired current density. The blades were then removed and rinsed in cold running water for about 30–45 seconds. The hard coatings thus obtained ranged in thickness about from 2 to 3 mils.

PART B. TREATMENT OF THE HARD ANODIC OXIDE COATINGS WITH SODIUM SILICATE SOLUTION

The blades containing the hard anodic oxide coating obtained as described in Part A were immersed for about 7 to 10 minutes in an aqueous sodium silicate solution of 8.2° Be' (sp. gr. 1.06) and pH 10.0 maintained at 170°–190° F (obtained by diluting commercial sodium silicate solution of 42° Be', sp. gr. 1.21, containing 9.1% $Na_2O$ and 29.46% $SiO_2$ and the balance water, with deionized water to 15% by volume). Thereafter the blades were rinsed for 15 to 30 seconds in cold running water, immersed in hot (180°–210° F) water for 1–2 minutes (to facilitate drying) and air-dried.

PART C. FLAME TESTS

The blades obtained in Part B, containing the hard anodic oxide coating sealed with sodium silicate solution, were subjected to laboratory oxyacetylene flame tests, wherein the flame was impinged normal to and covering a ¾ in. dia. circle on the blade for a period simulating the in-flight aerodynamic heating of the blade. The fin blades thus tested exhibited much better heat resistance than the blades obtained in Part A, wherein the hard anodic oxide coating was not sealed with sodium silicate but simply rinsed with cold water and dried.

PART D. PROJECTILE TESTS

Hypervelocity, kinetic energy, fin-stabilized subprojectiles were fitted with the aforesaid aluminum alloy fin blades, which contained the hard anodic coating sealed with aqueous sodium silicate produced as described in Part B. As shown in the drawing, each subprojectile 10 consisted of an elongated cylindrical aluminum body 11 1.4 in. dia. and 17.7 in. long having a tungsten steel alloy core (not shown), a steel tipped pointed forward end 12 and transverse parallel circumferential grooves 13 and lands 14 on the surface thereof. Six aluminum fin blades 15 with bevelled edges 16 and 17 of the type described in Parts A and B containing the silicate sealed hard anodic coating, were symmetrically mounted 60° apart along the longitudinal axis on the slightly tapered rear end 18 of the subprojectile body 11. Each subprojectile was assembled within a segmented aluminum sabot (not shown) having grooves and lands, which engaged the grooves and lands of the subprojectile body. The sabot of the subprojectile-sabot assembly was crimped to a conventional steel cartridge case containing a propellant and an initiator.

The subprojectiles were fired at extended ranges (beyond 2000 meters, muzzle velocity 1555 meters per second) with satisfactory results, i.e., there was no visible fin ablation on the rounds, as determined by (a) high speed smear camera photographs of the projectile located at various ranges and (b) recording the fin diameter of the hole left after passing through a wooden target at extended range. In comparison, corresponding projectiles fitted with fin blades of the aforesaid type containing the hard anodic coating, obtained as described in Part A but not sealed with sodium silicate solution, when fired in the same manner at extended ranges, gave unsatisfactory results, i.e., they suffered extensive fin ablation, as determined in the aforesaid manner.

Essentially identical results were obtained when the foregoing tests were repeated using fins obtained in Parts A and B except that the hard coating was sealed with a sodium silicate solution of sp. gr. 1.10 (13.2° Be') and pH 11.6 (obtained by diluting the aforesaid commercial sodium silicate solution of sp. gr. 1.21 (42° Be') containing 9.1% $Na_2O$ and 29.46% $SiO_2$ and the balance water, with deionized water to 25% by volume).

I wish it to be understood that I do not desire to be limited to the exact details of construction shown as described, for obvious modifications will occur to persons skilled in the art.

What is claimed is:

1. A hypervelocity kinetic energy projectile containing external aluminum stabilizing fins having a coating of high resistance to termodynamic ablation, said coating consisting essentially of a hard anodic oxide coating sealed by contact with an aqueous solution of an alkali metal silicate of the formula $Me_2O{:}x.SiO_2$, wherein Me is an alkali metal and $x$ is at least 2.0.

2. The projectile of claim 1, wherein the alkali metal silicate is sodium silicate.

3. The projectile of claim 2, wherein the hard anodic oxide coating is obtained by anodizing the aluminum component in an aqueous sulfuric acid electrolyte.

4. The projectile of claim 3, wherein the hard anodic coating is sealed by contact with an aqueous solution containing about from 5% to 10% by weight of sodium silicate in which the ratio of $SiO_2$ to $Na_2O$ is about 3.25:1.

* * * * *